US006126145A

United States Patent [19]

Mohr

[11] Patent Number: 6,126,145

[45] Date of Patent: Oct. 3, 2000

[54] FENCE WITH ADJUSTABLE PICKETS AND READILY DISMANTLABLE

[76] Inventor: Sylvia Ann Mohr, P.O. Box 596, 1170 Seeman Sp 2, Darrington, Wash. 98241

[21] Appl. No.: 08/966,075

[22] Filed: Nov. 7, 1997

[51] Int. Cl.[7] ..... E04H 17/14

[52] U.S. Cl. ..... 256/24; 256/21

[58] Field of Search ..... 256/21, 22, 24, 256/25, 12.5, 34; 49/74.1, 80.1, 92.1; 40/479, 480; 160/236

[56] References Cited

U.S. PATENT DOCUMENTS

| | | | |
|---|---|---|---|
| 265,841 | 10/1882 | Marteeny | 40/479 |
| 1,015,431 | 1/1912 | Farnum | 40/479 |
| 2,789,792 | 4/1957 | Davis | 256/24 |
| 2,973,943 | 3/1961 | Loter et al. | 256/24 X |
| 3,137,043 | 6/1964 | Moeller | 49/74.1 X |
| 3,342,458 | 9/1967 | Simonton | 256/24 |
| 3,368,798 | 2/1968 | Kusel et al. | 256/21 X |
| 4,099,346 | 7/1978 | Isono | 49/82.1 |
| 4,214,734 | 7/1980 | Stafford | 256/24 |
| 4,597,357 | 7/1986 | LeMessurier | 40/479 X |
| 4,709,506 | 12/1987 | Lukaszonas | 49/92.1 X |

FOREIGN PATENT DOCUMENTS

| | | | |
|---|---|---|---|
| 493150 | 5/1950 | Belgium | 40/479 |
| 1023706 | 3/1953 | France | 40/479 |
| 344596 | 5/1937 | Italy | 49/92.1 |

*Primary Examiner*—Harry C. Kim

[57] ABSTRACT

A fence is disclosed where the pickets are mounted on longitudinal pivots so that the pickets may be rotated to present the broad face, narrow face, or any angle between to the zone in front of the fence. Adjustment allows the setting of the opening for light and air passage or changing color or decoration by having different colors or scenes on the opposite sides. The fence is easily dismantled in all or part for repair, painting, or moving to another location. Wind rotated pickets are also described.

5 Claims, 4 Drawing Sheets

FENCE WITH ADJUSTABLE PICKETS AND READILY DISMANTLABLE

CROSS REFERENCE TO RELATED APPLICATIONS

The present application incorporates by reference Provisional application Ser. No. 60/027,059 titled "FENCE WITH ADJUSTABLE PICKETS AND READILY DISMANTLED", filed on Sep. 30, 1996.

BACKGROUND OF THE INVENTION

1. Field of Invention

Fence structure with panels having movable portions.

2. Description of Prior Art

Fences are built for several purposes. In general, attractiveness is sought, but the common fence has a "good" and a "bad" side. Several designs are available that have equal sides, but these usually are more complex to construct and significantly more difficult to paint. Once built, the common fence is permanent and can be changed only superficially without complete re-construction. Moving a section of fence is usually a significant re-construction task. Furthermore, the common fence has its elements rigidly attached to one another, therefore the design and appearance being fixed at time of construction.

The present invention constructs a fence in removable sections and also having rotating portions. It is fastened together with pins so that any or all of it may be replaced or rearranged readily without dismantling the remaining fence. Most of the painting operations can be done from one side because the elements of the fence can be rotated, presenting the faces to be painted toward a convenient painting station.

The appearance of the fence built to the specifications of the present invention can be changed by turning the picket portions, presenting different aspects of the pickets, or the picket portions can be rearranged, replaced, repaired, or re-painted conveniently.

3. Objects of the Invention

It is an object of the invention to fit a fence with changeable pickets, in particular pickets that rotate about a longitudinal axis to present either side of the picket or the pickets being at an angle.

It is another object of the invention to permit change of the fence panel openings to vary its ability to pass air and light.

It is another object of the invention to permit easy partial or complete dismantling of the fence for repair, replacement, removal, or re-installation.

It is another object of the invention to permit easy changing of the the pickets so the design and or appearance may be changed.

It is another object to be able to adjust the fence to present reduced wind resistance to prevent destruction of the fence by wind storm.

It is another object of the invention that the fence have both sides equally attractive. That is there is no "good" or "bad" side.

It is another object of the invention to have motion imparted to the pickets by wind, thereby providing a constantly changing appearance.

It will be seen that the invention described herein overcomes the limitations of the prior art and meets the objectives set forth and others that will become obvious from the disclosure.

SUMMARY OF THE INVENTION

Sections of fencing built either in frames or between conventional posts are fitted with rotating pickets acting as shutters for opening and closing a passage for air and light. The pickets may be mounted in any position, vertical or horizontal orientation being the most common.

The fence appearance may be changed by rotating the pickets to present one or another face to the world.

ELEMENT INDEX

Figure 2:
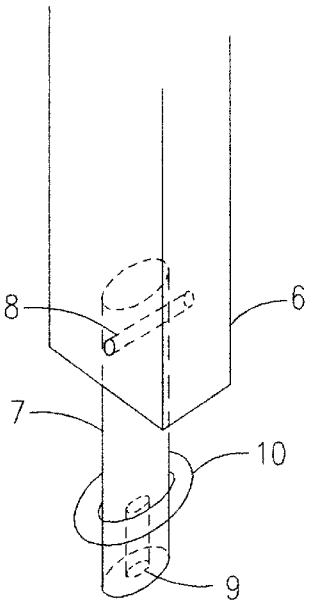
FIG. 2 is a partial view of the pin assembly.

1. Fence, general
2. top rail
3. bottom rail
4. fence post
5. pivot bearing holes
6. picket (slat)
7. pivot pin
8. pivot pin retaining pin
9. withdrawal socket or bearing
10. thrust washer
11. wind rotor blade
12. wind spinner, generally
13. wind spinner twisted band
14. wind spinner pivot
15. U bracket for picket
16. blade bracket for picket
17. upper rail, lower rail
18. rail support bracket
19. pivot pin
20. picket (slat)
21. Fence section, general
22. Top rail
23. Bottom rail
24. Bracket
25. Frame end pieces

DESCRIPTION OF THE PREFERRED EMBODIMENT

Figure 1:
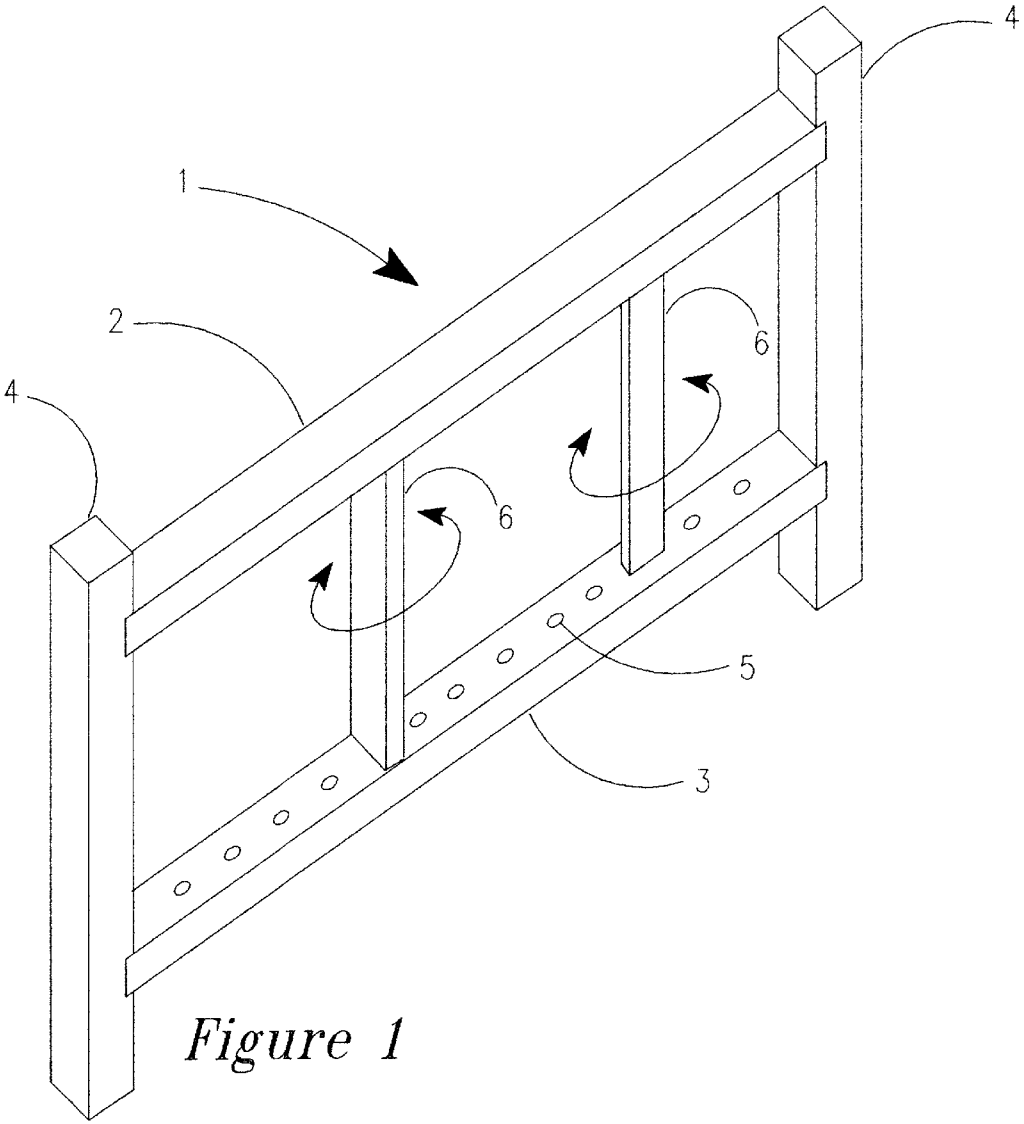
FIG. 1 a view of the preferred embodiment with vertical pickets.

The preferred embodiment of the fence is shown in FIG. 1 as 1 generally. Top and bottom fence rails 2, 3, are conventionally mounted between conventional fence posts 4. FIG. 1 shows the rails mounted in inlets within the posts, and fastened with lag bolts or screws (not shown) into the ends of the rails This is the preferred method, but any of the conventional methods of fence assembly are adequate.

The distance between posts is determined by conventional fence design criteria, usually between 6 and 10 feet. The rails may be stiffened if necessary by conventional means. The posts are preferably set in sockets for easy removal, but may be set into the ground or other common fence post holding means.

A set of holes 5 are drilled in the upper and lower rails. Preferably, the holes in the lower rail pass completely through the rail to permit water to drain and to provide passage for the rotation pin to be withdrawn to release the picket.

The line of pickets may be extended above the top rail for artistic or functional purposes (not shown). The upper extensions may be either fixed on the upper rail, pivoted independently, or preferably, in conjunction with the main body of the picket. The upper pivot pin is extended through the upper rail into the picket extension. Retaining pins are recommended, but not required, in both the picket extension and the upper end of the main picket body.

The holes in the top rail are closed as shown when no picket extension is to be used.

Pickets 6 extend between the top and bottom rails. FIG. 1 shows the extremes of rotation.

FIG. 2 details the pivot pin in the picket. The pivot pin 7 is shown as retained within the picket 6 by a retaining pin 8. A threaded hole 9 in the bottom of the pivot pin is optional to attach a pulling tool. Alternatively, the pivot pin extends through the rail so the end can be grasped by a pair of pliers. An alternative pivot pin installation is to attach the pivot pin to the rail, either by a holding pin or a removable cap under the rail. While retaining pins 8, are shown, the industry has equally effective methods available, including threaded rod of metal, wood, or plastic, or press fit. The preferred material for the pivot pins and retaining pins is plastic rod because plastic is dimensionally stable and corrosion resistant. Thrust washer/spacers 10 under the bottom of the picket reduces friction and makes a space for drying rain water trapped between the picket and bottom rail.

The pivot pins at the top rail are inherently captured and do not require a holding pin.

The fence is constructed of any suitable material such as wood, metal, or plastic products and may be either opaque, translucent, or transparent. Combinations of these and other materials, opacity, and colors can be artistically and structurally combined at will.

Hole spacing in the rails is chosen according to the desires of the architect. Generally, the holes will be spaced apart slightly further than the wide dimension of the pickets. When spaced less than the width of the pickets, the pickets can be closed overlapping forming a solid zig-zag surface. Spacing the holes exactly the width of the pickets is not allowed unless the narrow edges of the pickets are beveled sufficiently to give clearance between the corners of adjacent pickets as they are rotated to the closed position. The cross-sectional shape of the resulting beveled pickets will be a parallelogram.

TO USE THE INVENTION

Figure 8:
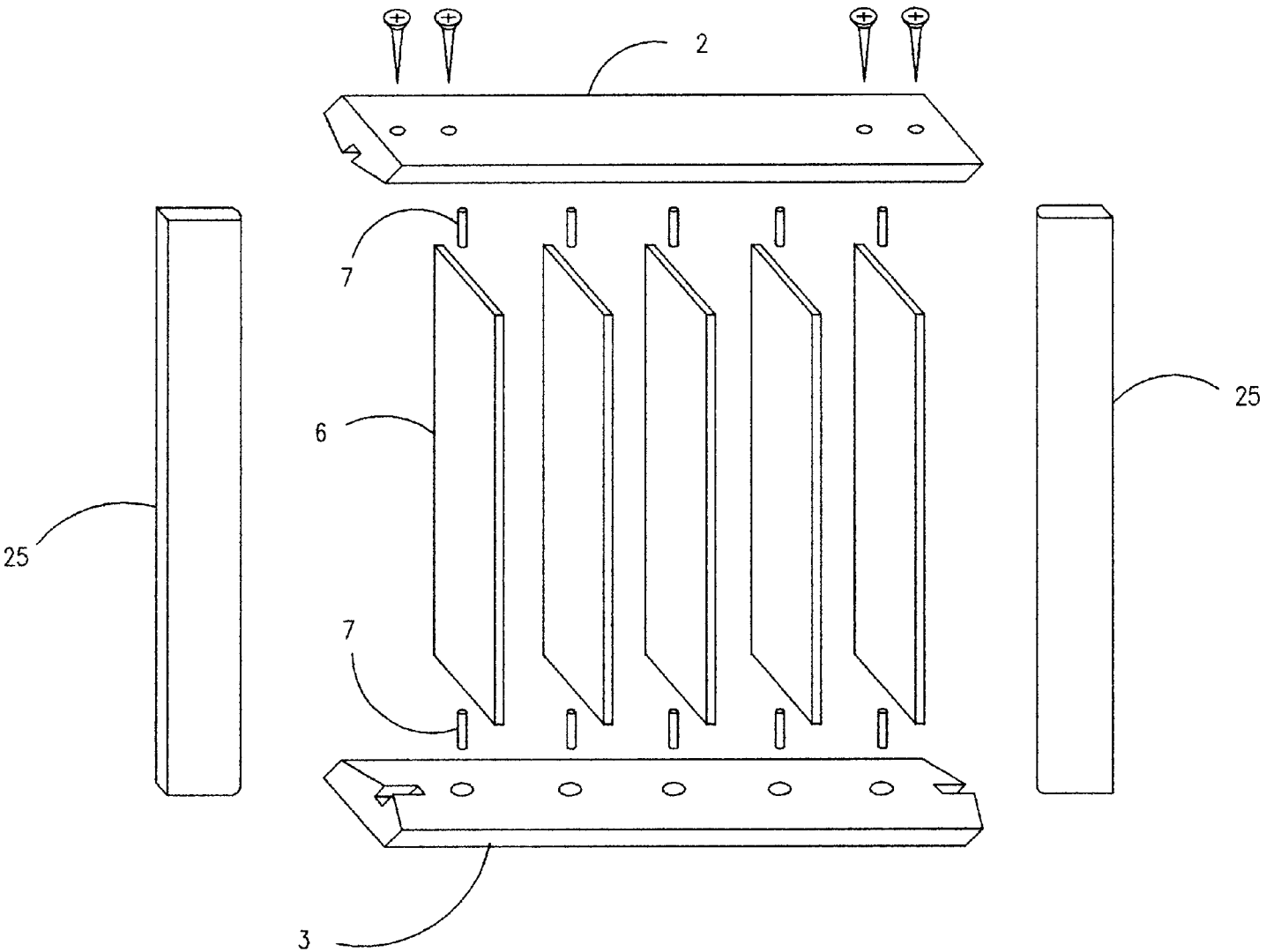
FIG. 8 is an exploded view of a removable section of fencing.

To use the invention, fence posts are set in the usual manner and spacing. Fence sections are constructed in accordance with this specification, either integrally utilizing the posts as end section end pieces as shown in FIG. 1 or as independent panel sections as shown in FIG. 8. Fence sections of the style shown in FIG. 8 are placed between the posts and fixedly or removably secured. Suitable fastening between posts is pintles and gudgeons for quick removability or screws and appropriate supporting bracketry or for less temporary installation.

The pickets are then rotated as desired to present various patterns of openings for passage of light and/or air and to present various appearances of the installed fence.

The fence posts described may be supported on stands or other means as alternative to fixed setting. Thus, the installed fence sections become totally portable.

OTHER EMBODIMENTS

The pickets may be of any convenient cross section. Rectangular is shown, but round, oval, square, or triangular cross sections will suffice. Square and triangular have 4 and 3 faces respectively.

Figure 6:
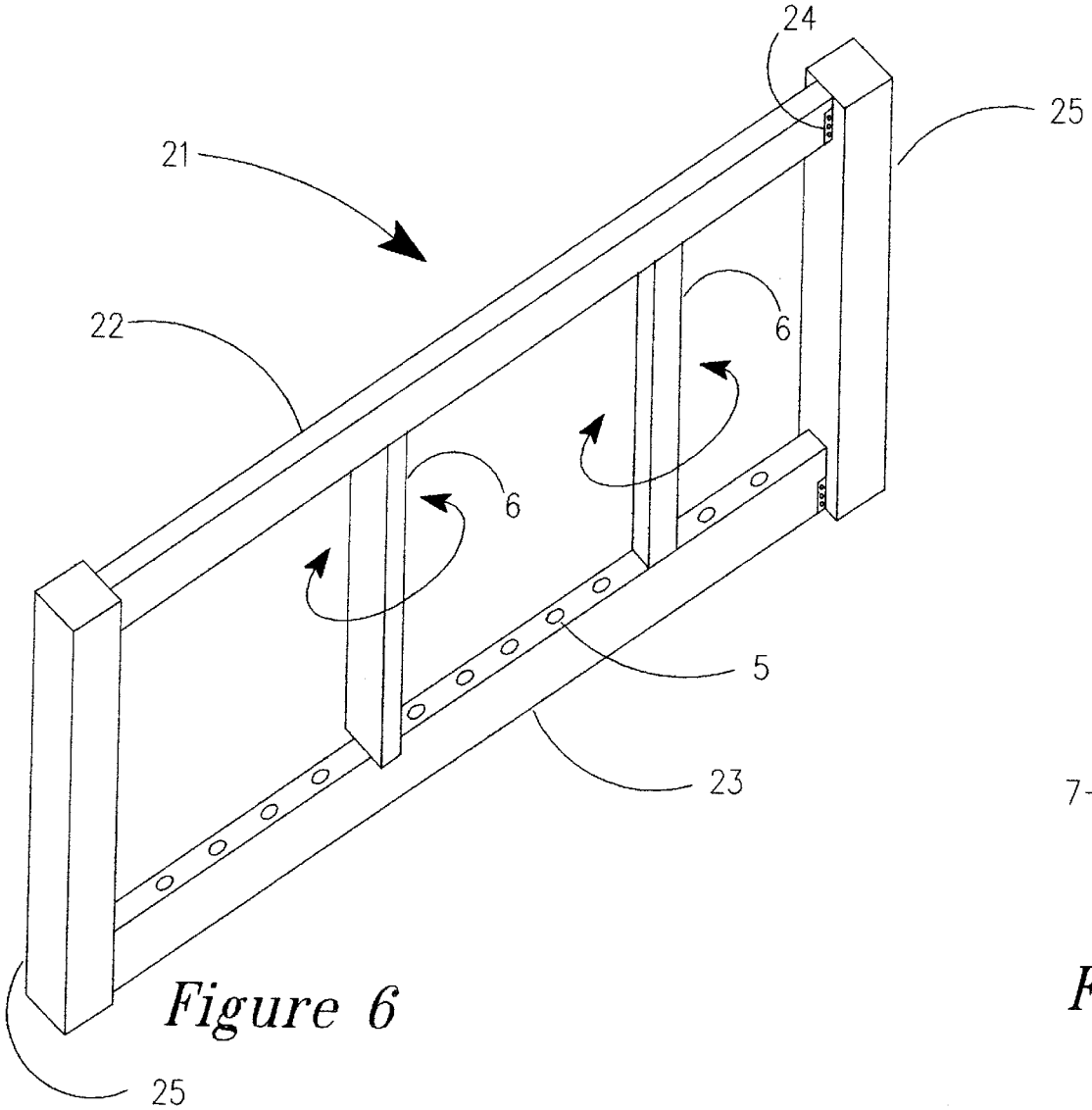
FIG. 6 is a view of an optional embodiment with vertical pickets.

An optional embodiment of the fence is shown in FIG. 6 as 21, generally. The difference between the preferred embodiment and FIG. 6 is;

A) Top and bottom fence rails 22, 23 are mounted on edge in conventional brackets 24 between frame end pieces 25.

Figure 7:
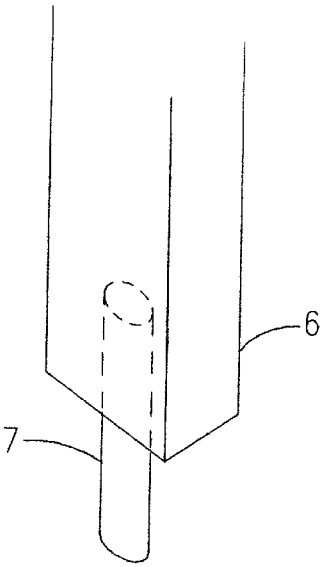
FIG. 7 is a partial view of an optional embodiment of the pin assembly.

B) FIG. 7 illustrates the pivot pin 7 installed with a press fit along the axis of picket 6.

The invention may be practiced with the picket members aligned horizontally. This embodiment permits more sunlight to pass between the pickets onto the adjacent flower beds or the like while providing sight screening from more horizontal vantage points.

The invention may be practiced with the picket members aligned diagonally. double-stacked vertically, or in any number of combinations. These embodiments permit the architect artistic creativity.

Figure 3:
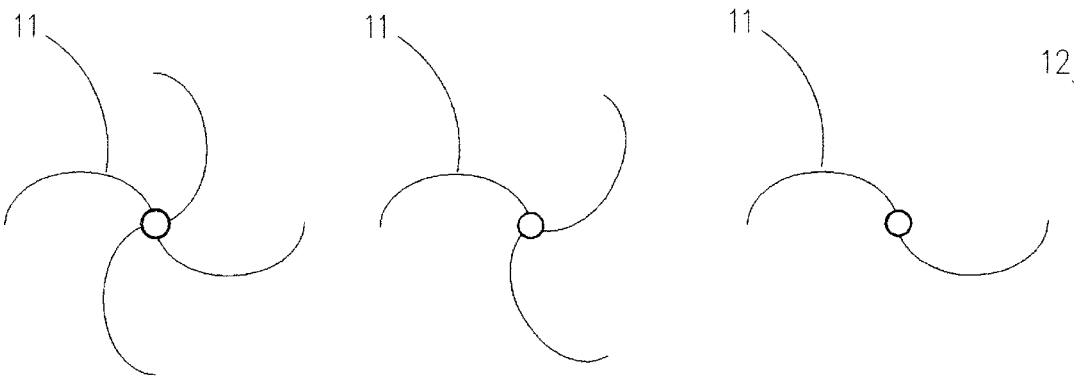
FIG. 3 are cross sections of typical rotary wind driven pickets.

FIG. 3 shows wind driven pickets having various wind-catching blades designed to rotate in a breeze. The curved vanes 11 catch wind differentially, producing turning forces to rotate the pickets. Two, three, and four vane rotors have been found to work in other wind driven applications. Specific bearing arrangements are not required. The ordinary mechanic should be able to choose suitable bearings without significant experimentation. The simplest being a single round ball between the pulling hole 9 and a retaining cap (not shown) under the ball. A wear-resistant bearing piece may be inserted in the pulling hole for longer bearing life.

Figure 5:
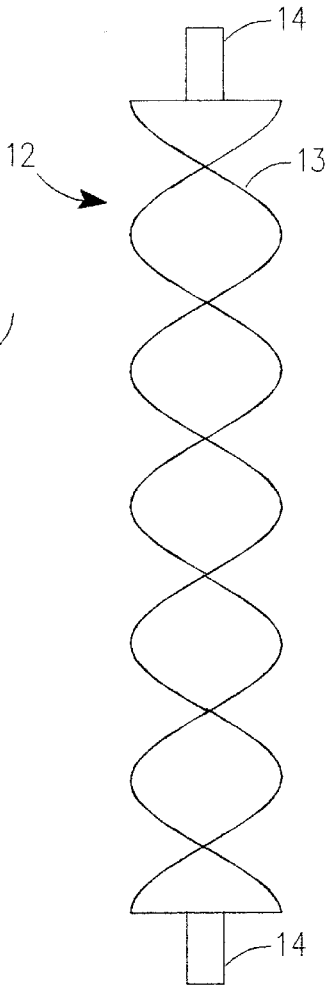
FIG. 5 depicts a twisted band wind rotor.

The screw shaped spiral embodiment shown in FIG. 5 catches wind differentially and rotates the picket producing a screw-like motion having an attractive disposition. The spiral picket 12 is a band of metal or plastic 13 twisted along the axis. Pivots 14 at each end are similar to the pivots described previously.

The pickets can be colored differently from each other and on each side or can carry murals to be exposed and changed periodically.

Figure 4:
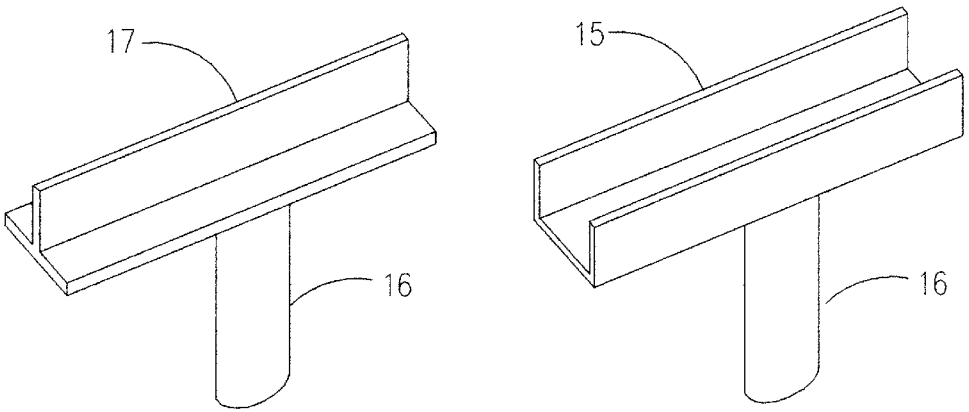
FIG. 4 depicts two bracket type pivot assemblies.

The preferred embodiment illustrates pins in holes within the ends of the pickets to hold the pickets in place yet permit rotation. Various bracket assemblies are equally suitable for the proper function of the invention. See FIG. 4. Typical would be U 15 or box bracket (the U bracket shown, but further including end panels) attached to the pivot pin 16, where the end of the picket is cradled in the U or box. Another acceptable holding assembly is an up-side down T 17 in a slot cut into the end of the picket. Additional holding power if required would be by pinning, screws, bolts, or bracket barbs.

The illustrations show the rotation pins being individual components. Some constructions of picket and/or rails, such as molded or fabricated in one piece, may utilize integral pin structures without violating the intent of this specification.

The drawings show conventional pickets having essentially two wide faces and two narrow edges. Variants of picket may have three, four, or more faces of similar wide dimension, each of which can carry different color, pattern, or portions of a mural, thereby permitting a larger variety of displays than occur with the simpler two sided picket.

The word "picket" is intended to include all structures structures performing the functions described herein including, but not limited to those with width significantly greater than thickness, more aptly described a "panel"; those with width nearly equal to thickness, more aptly described as a "post"; those with intermediate widths and thicknesses; and other cross sectional shapes capable of performing the described functions.

Accordingly, it will be seen that the subject attachment is markedly simple and effective to manufacture and use, with reliable, inexpensive fabrication from readily available materials. It will be obvious to those skilled in the art that various changes and modifications can be made to the present invention and it is intended that all such modifications that are within the scope of the invention be covered by the appended claims.

I claim:

1. A fence panel comprising a pair of spaced horizontal members and a pair of spaced vertical members connected to the horizontal members, a plurality of slats rotatably mounted between said spaced horizontal members, each of said slats having a longitudinal axis and a bearing means for permitting the slats to rotate, each said slat being spaced apart from each other to allow each said slat to be independently rotatable along the longitudinal axis with respect to each other without any portion of the adjacent slats overlapping each other, wherein each said slat being twisted about the longitudinal axis to form a spiral shape, whereby the spiral shape allows moving air passing over the slat to impart energy to the slat to cause the slat to be freely rotatable.

2. The fence panel of claim 1, wherein said bearing means comprises a pivot pin disposed on the ends of each said slat.

3. The fence panel of claim 2, further comprising a thrust washer disposed on the pivot pin for reducing friction between the slat and the horizontal member.

4. The fence panel of claim 1, wherein sides of said vertical members have brackets mounted thereon for receiving the ends of the horizontal members to connected the vertical and horizontal members together.

5. The fence panel of claim 1, wherein sides of said vertical members have notches thereon for receiving the ends of the horizontal members to connected the vertical and horizontal members together.

* * * * *